US007029043B2

(12) United States Patent
Fisher

(10) Patent No.: US 7,029,043 B2
(45) Date of Patent: Apr. 18, 2006

(54) LATCH ASSEMBLY AND LATCH

(75) Inventor: Sidney Edward Fisher, Worcestershire (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 10/683,470

(22) Filed: Oct. 9, 2003

(65) Prior Publication Data

US 2004/0104592 A1 Jun. 3, 2004

(30) Foreign Application Priority Data

Oct. 11, 2002 (GB) ..... 0223618

(51) Int. Cl.
*E05B 15/02* (2006.01)

(52) U.S. Cl. ..... 292/341.13; 292/DIG. 40

(58) Field of Classification Search ..... 292/337, 292/1, DIG. 39, DIG. 40, DIG. 51, 340, 292/341.13, DIG. 56, DIG. 55
See application file for complete search history.

(56) References Cited

U.S. PATENT DOCUMENTS

| | | | | |
|---|---|---|---|---|
| 2,187,530 | A * | 1/1940 | Butler | 292/341.12 |
| 2,712,957 | A * | 7/1955 | Marpie | 292/279 |
| 2,929,652 | A * | 3/1960 | Martens et al. | 292/341.13 |
| 3,371,948 | A * | 3/1968 | Velavicius | 292/216 |
| 4,165,112 | A * | 8/1979 | Kleefeldt | 292/216 |
| 4,756,563 | A | 7/1988 | Garwood et al. | |
| 4,869,023 | A | 9/1989 | Bakula et al. | |
| 5,069,491 | A | 12/1991 | Weinerman et al. | |
| 5,125,698 | A * | 6/1992 | Thau | 292/216 |
| 2002/0000727 | A1 | 1/2002 | Rass et al. | |

FOREIGN PATENT DOCUMENTS

| | | |
|---|---|---|
| DE | 3713558 | 8/1988 |
| DE | 10135030 | 2/2002 |
| EP | 0272116 | 6/1988 |
| EP | 0314075 | 5/1989 |
| GB | 300411 | 11/1928 |
| GB | 409095 | 4/1934 |

OTHER PUBLICATIONS

European Search Report Dated Dec. 12, 2002.

* cited by examiner

*Primary Examiner*—Gary Estremsky
(74) *Attorney, Agent, or Firm*—Carlson, Gaskey & Olds

(57) ABSTRACT

A latch bolt engages a striker to releasably secure a first door to a vehicle body or a second door by relative displacement of the latch towards the striker. The latch bolt moves in a first plane to releasably retain the striker. The assembly includes a vertical wedge arrangement includes a first wedge surface on the latch and a second wedge surface on the striker. The first wedge surface and the second wedge surface cooperate to compensate for any misalignment and to prevent movement between the striker bar portion of the striker and a mouth of the latch in a direction parallel to the first plane. The latch is a plant-in latch, and the first surface is provided on a wedge plate securable to a shut face surface of the latch. The first wedge surface and the second wedge surface can be resilient.

9 Claims, 3 Drawing Sheets

LATCH ASSEMBLY AND LATCH

REFERENCE TO RELATED APPLICATIONS

This patent application claims priority to Great Britain Patent Application No. GB 0223618.0 filed on Oct. 11, 2002.

TECHNICAL FIELD

The present invention relates generally to a latch assembly for a vehicle including a latch and a striker having a cooperating wedge arrangement.

BACKGROUND OF THE INVENTION

Light commercial vehicles such as panel vans (vans in which the load space is enclosed), typically include a relatively large rear opening closeable by two rear doors hinged to the rear most edge of each side of the van. A primary latch is typically provided partially up the shut-face of one of the rear doors. The primary latch is arranged to latch with a complementary striker provided on the shut face of the other rear door when the doors are closed. The latch may also operate shoot bolts or supplementary latches fitted to the upper and lower edges of the door fitted with the latch where the shoot bolts or supplementary latches are arranged to engage in complementary holes or strikers in the door surround. The shoot bolts or supplementary latches provide additional latching strength to the doors when closed, resist flexing of relatively tall doors during vehicle motion, and resist any attempts to force the latched doors open.

The axes of the two hinges used to mount each door should be co-axially arranged for the hingable mounting to function. The sides of these vans often converge towards the van roof, making it necessary to mount the hinges some distance below the top of the shut-face of each door. Furthermore, a significant proportion of the structural integrity of the rear of the van load space is imparted by the closed rear doors. When the rear doors are open, the roof and side panels of the rear load space may deflect, and the doors may flex. The hinges can also wear over time. These factors may move the rear doors out of alignment, leading to difficulties in aligning the latch with the striker and/or the shoot bolts in the respective holes. This may cause problems in latching the doors.

The deflection of the roof and the side panels of the doors during vehicle motion may lead to rattling caused by play between the latch and the striker. This may increase wear on both the latch and the striker, increasing noise.

There are three types of latches which can be mounted partially up the shut-face to releasably secure a door to the striker mounted on another door or a door surround and to ensure that the striker engages a mouth in a corner of the claw. The latches can be 1) "plant-on," in which the entire latch mechanism is mounted externally on the door of the door shut-face, 2) "plant-through," in which the majority of the latch mechanism is mounted within the body of the door, but the claw and its housing protrude through the door of the door shut-face, and 3) "plant-in," in which the entire latch, including the claw, is mounted within the body of the door and an opening corresponding to the mouth of the latch is provided in the door skin. The striker is able to engage the claw by entering the opening and the mouth.

Arrangements to vertically align latches and strikers are known for plant on and plant through latches, but are not known for plant-in latches.

SUMMARY OF THE INVENTION

An object of the present invention is to provide an arrangement that vertically aligns plant-in latches with complementary strikers and to minimize vertical relative movement when the latch and striker are latched together.

Either a latch or a striker of a latch assembly is mountable to a first vehicle door. The other of the latch or the striker is mountable to a vehicle body or a second door of the vehicle. The latch includes a latch bolt that engages the striker to releasably secure the first door to the vehicle body or the second door by relative displacement of the latch towards the striker. The latch bolt moves in a first plane to releasably retain the striker. The latch assembly further includes a vertical wedge arrangement that includes a first wedge surface on the latch and a second wedge surface on the striker. The first wedge surface and the second wedge surface cooperate to compensate for any misalignment and to prevent movement between a striker bar of the striker and a mouth of the latch in a direction substantially parallel to the first plane. The latch is a plant-in latch, and the first surface is provided on a wedge plate and is securable to a shut face surface of the latch. One or both of the first wedge surface and the second wedge surface can be resilient.

Alternately, the latch is a plant-in latch including a latch body mounted within a door skin of a vehicle door and a wedge plate having a wedge surface mounted to a shut face of the door. The body and the wedge plate are secured together by a fastener, and the door skin is sandwiched between.

These and other features of the present invention will be best understood by the following specification and drawings.

DETAILED DESCRIPTION OF THE DRAWINGS

Embodiments of the present invention are now described, by way of example only, with reference to the accompanying drawings, in which.

DETAILED DESCRIPTION OF THE PREFERRED EMBODIMENT

Figure 1:
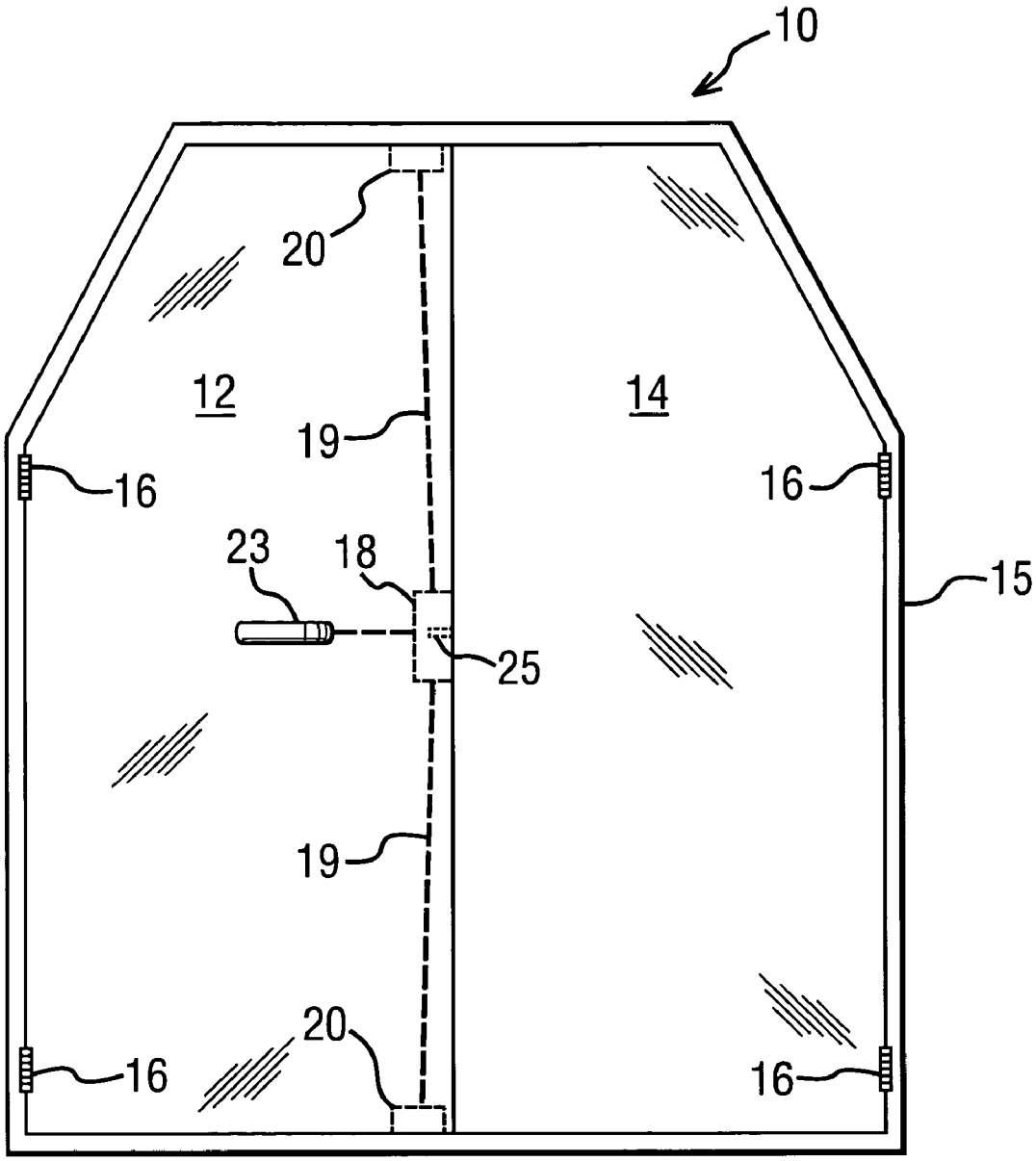
FIG. 1 is a rear view of the doors of a van or light commercial vehicle incorporating latches and strikers of the latch assembly of the present invention.

FIG. 1 illustrates the rear of a light commercial vehicle 10, such as a van. The rear of the vehicle 10 includes a first rear door 12 and a second rear door 14 pivotally mounted to a door surround 15 by hinges 16. The first door 12 is opened first, followed by the second door 14, to gain full access to the vehicle load area. A primary latch 18 is mounted proximate to the shut-face of the first door 12 to engage and releasably retain a complementary striker 25 provided on the opposed shut-face of the second door 14. The primary latch 18 defines an arcuate path in a single substantially horizontal second plane when moving between an open position and a closed position. The primary latch 18 is lockable to prevent unauthorized access to the load space of the vehicle 10.

Linkages 19, such as connecting rods or Bowden cables, extend from the top and the bottom of the primary latch 18 to connect the primary latch 18 with secondary latches 20 mounted proximate the top and bottom of the first door 12. The secondary latches 20 are positioned to engage the complementary strikers 22 mounted to the door surround 15 of the vehicle 10. When the first door 12 is closed, it is latched to both the second door 14 and to the door surround 15, securely retaining both the doors 12 and 14 in a closed position relative to the door surround 15. An outside release handle 23 can be pulled when the primary latch 18 is unlocked to simultaneously release both the primary latch 18 and the secondary latches 20 (by virtue of linkages 19).

Figure 2:
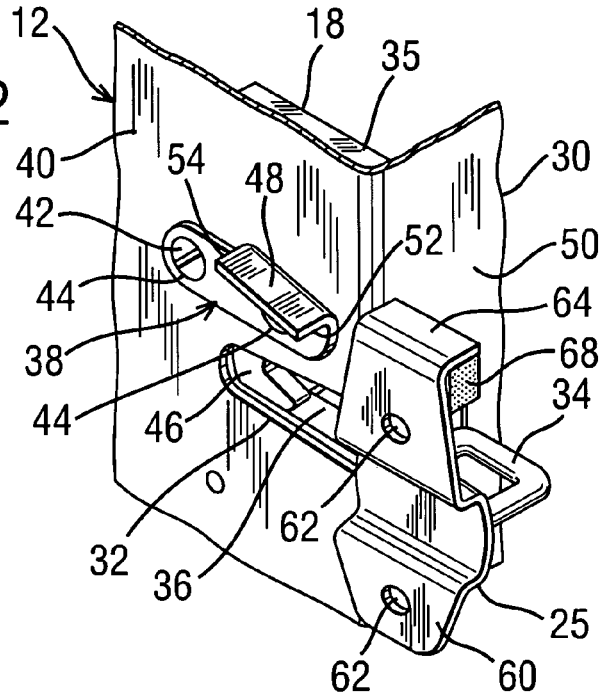
FIG. 2 is a perspective view of a latch and a striker of a latch assembly according to a first embodiment of the present invention.
Figure 3:
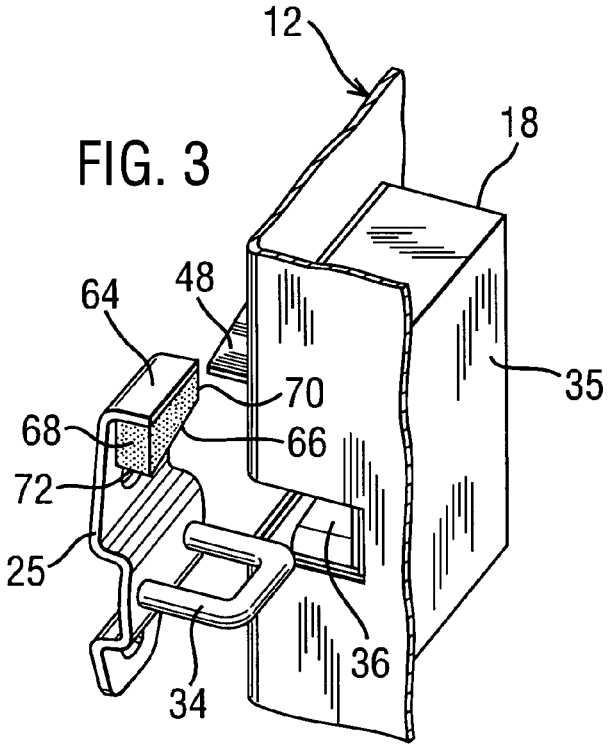
FIG. 3 is another perspective view of the latch and the striker according to the first embodiment of the present invention.

FIGS. 2 and 3 illustrates the primary latch 18 and a striker 25 of a first embodiment of the latch assembly of the present invention in an unlatched condition. The primary latch 18 is a plant-in latch. That is, the primary latch 18 is fitted inside the door skin 30 of the first door 12, and a cut out 32 in the door skin 30 allows access to the primary latch 18. A shut-face 40 of the door skin 30 intersects an inside face 50. The primary latch 18 includes a housing 35 having a mouth 36 arranged to receive a striker bar 34 of the striker 25. A latch bolt in the four of a rotatable claw 46 is pivotally mounted within the housing 35. The claw 46 is resiliently biased into an open position and a latch mechanism (not shown) forms part of a transmission path between the outside release handle 23 and the claw 46. When the striker 25 is introduced into the mouth 36, the claw 46 rotates and is retained by a pawl (not shown) of the primary latch 18, releasably retaining the claw 46 within the mouth 36, as known. The front of the primary latch 18 is mounted proximate to the inside face 50 of the door skin 30.

The claw 46 rotates about a pin (not shown) and moves in a first plane substantially parallel to the shut-face 40 from a released position (shown in FIGS. 2 and 3) to a latched position. With the latch 18 is installed in a vehicle 10, as shown in FIG. 1, the first plane is substantially vertical and essentially perpendicular to the second plane. However, it is to be understood that other installations are possible.

A wedge plate 38 on the shut-face 40 of the door skin 30 is secured through the door skin 30 into the primary latch 18 with screws 42. The screws 42 are rated within holes 44 in the wedge plate 38. Therefore, a fixed spatial relationship exists between the wedge plate 38 and the mouth 36 of the primary latch 18. Preferably, the screws 42 mount the primary latch 18 to the door skin 30. The holes 44 may be located such that the wedge plate 38 may be secured to a pre-existing primary latch 18 having holes 44 intended to mount the primary latch 18 to the door skin 30 without any modification of the primary latch 18.

The wedge plate 38 includes a first wedge surface 48 inclined downwardly towards the front of the primary latch 18. That is, the front 52 of the first wedge surface 48 is slightly lower than the back 54. The first wedge surface 48 is formed integrally with the wedge plate 38 by bending a portion of the wedge plate 38 substantially 90 degrees to form a flange.

The striker 25 includes a mounting plate 60 having holes 62 that allow the striker 25 to be mounted to the shut-face 40 of the door 14. A flange 64 is formed in the top of the mounting plate 60 and projects in the same direction as and substantially parallel to the striker bar 34. A second wedge surface 66 is formed in a resilient wedge block 68 secured to the underside of the flange 64. The second wedge surface 66 is inclined relative to the flange 64 such that the front 70 of the flange 64 is higher than the rear 72 of the flange 64. The angle of incline is substantially equal to the angle of incline of the first wedge surface 48. The striker 25 is mounted on the door 14 at a height such that the front 70 of the second wedge surface 66 is slightly lower than the front 52 of the first wedge surface 48. Together, the surfaces 48 and 66 define a vertical wedge arrangement.

Figure 3A:
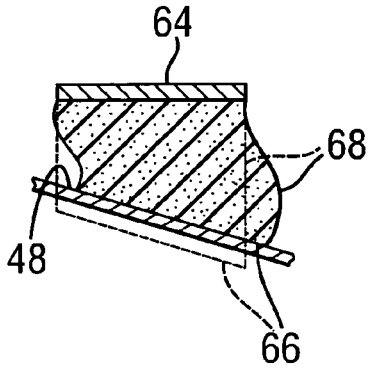
FIG. 3A is a vertical cross-sectional view through the wedge arrangement of the latch assembly when in a latched condition.

When a vehicle user closes the first door 12, the stationary striker bar 34 mounted on the second door 14 enters the mouth 36 of the primary latch 18 and is releasably secured by the claw 46. The first wedge surface 48 is brought into contact with the second wedge surface 66. The relative spatial relationship between the wedge surfaces 48 and 66, the striker bar 34 and the claw 46 requires some deformation of the wedge block 68 to bring the primary latch 18 into a fully latched condition. As shown in FIG. 3A, the deformation (shown in solid lines, with the original shape of the wedge block 68 shown in broken lines) is a combination of a degree of "barrelling" caused by the compression forces of the wedging action combined with a translation of the second wedge surface 66 relative to the flange 64 in a direction towards the rear of the striker 25 due to frictional forces having a horizontal component. When the closing action stops, the resilience of the wedge block 68 both biases the first wedge surface 48 away from the flange 64 in a vertical direction and urges the striker bar 34 out of the mouth 36. Therefore, the vertical wedge arrangement increases forces acting between the claw 46 and the pawl.

The vertical wedge arrangement compensates for any vertical misalignment that occurs between the primary latch 18 and the striker 25 due to, for example, sagging at the hinges 16 of the door 12, ensuring that the striker bar 34 enters the mouth 36. The vertical wedge arrangement also minimizes relative movement that may occur between the striker 25 and the primary latch 18 when latched together, and may reduce rattling noise and wear of the primary latch 18 and the striker 25 due to vibrations during vehicle use.

Figure 4:
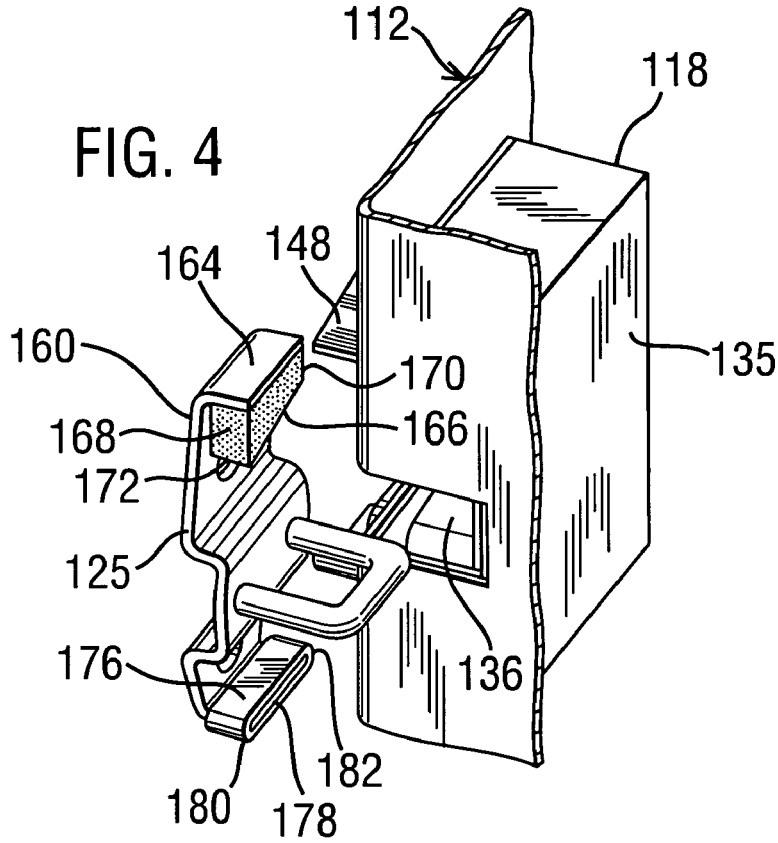
FIG. 4 is a perspective view of a latch and a striker according to a second embodiment of the present invention.
Figure 5:
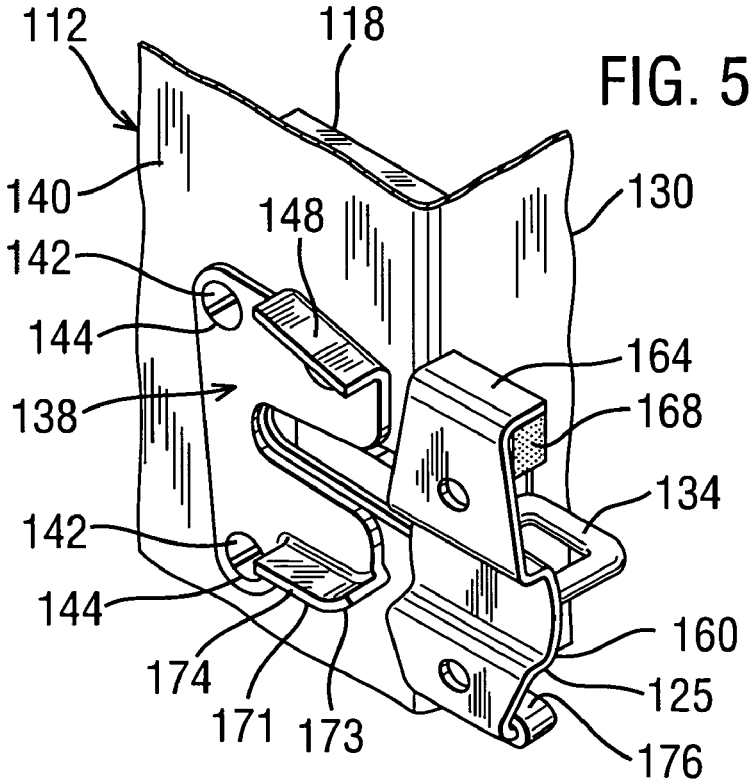
FIG. 5 is a perspective view of the latch and the striker according to the second embodiment of the present invention.

FIGS. 4 and 5 illustrate an alternate embodiment of the primary latch 18 and the striker 125. Only differences with respect to the latch assembly of the first embodiment are discussed in Further detail, and like parts are denoted, wherever possible, by like numerals with the addition of the prefix "1".

The wedge plate 138 is enlarged and extends below the mouth 136. A third wedge surface 171 is provided beneath the mouth 136 and extends substantially perpendicularly away from the shut-face 40 of the door 12. The third wedge surface 171 includes a substantially planar rear region 174 arranged to be substantially parallel to the second plane. The third wedge surface 171 further includes an upturned front curved region 173 that assists in guiding the latch 118 into engagement with the striker 125.

The striker 125 further includes a fourth wedge surface 176 formed from a flange 178 of the body portion 160 of the striker 125 bent into a horizontal orientation. The flange 178 is encircled with a plastic component 180 having a curved front region 182. When installed on the respective shut-faces, the curved regions 173 and 182 are arranged to ensure that the third wedge surface 171 passes above the fourth wedge surface 176.

Operation of the wedge arrangement of the second embodiment is similar to that of the first embodiment. However, in this embodiment, the wedging action occurs solely between the wedge plate 138, which is forced into compression between the first and third surfaces 148 and 171, respectively, and the striker 125 which is forced into tension between the surfaces 166 and 176, rather than between the surfaces 48 and 66 and the interaction of the striker bar 34 with the claw 46. A reduced loading on the striker bar 134 and the claw, which may increase the durability of the latch assembly and improve the wedging action.

The latch assembly of the present invention provides a simple and cost effective way of providing vertical wedging that ensures reliable latching, even with degrees of misalignment between the components being latched together. The latch assembly also minimizes rattling between the primary latch 18 and the striker 25, minimizing noise and wear in the latch assembly. The wedge plate 38 may be designed for use with existing primary latches 18 without the primary latch 18 requiring modification.

The latch assembly of the present invention may be combined with further wedging in the lateral and vertical directions, such as between the secondary latches and corresponding strikers.

It should be appreciated that the various terms used to describe the orientation of the various primary latch 18 and the striker 25 components in the description are being used for ease of understanding, and should not he regarded as limiting. The primary latch 18 and the striker 25 of the present invention may be orientated in any direction as required by the latching of one to the other.

It should further be appreciated that numerous changes may be made within the scope of the present invention. For example, the construction of both the primary latch 18 and the striker 25 may be altered Furthermore, the invention may be applied to types of primary latches 18 which do not operate using a rotatable claw 46 type latch bolt. The positions of the tint, second, third and fourth surfaces may be altered, and the resilient wedge block 68 may be provided on the wedge plate 38 rather than the striker 25. One of the first and second wedge surfaces may also be horizontal, rather than inclined.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch assembly mountable in a body of a vehicle comprising:

a latch including a latch housing having a mouth and an exterior shut face, a claw-type latch bolt rotatable in a first plane, and a wedge plate securable to the exterior shut face of the latch housing and having a first wedge surface, wherein the latch is mountable to a first vehicle component selected from one of a vehicle door and a vehicle body and the wedge plate is releasably securable to the latch, wherein the first vehicle component includes a skin, and the skin is located between the latch and the wedge plate;

a striker including a striker bar engageable by the claw-type latch bolt and a second wedge surface, wherein the striker is mountable to a second vehicle component which is the other of the vehicle door and the vehicle body, and engagement of the claw-type latch bolt and the striker bar releasably secures the first vehicle component to the second vehicle component by relative displacement of the latch towards the striker; and a vertical wedge arrangement including the first wedge surface and the second wedge surface, wherein the first wedge surface and the second wedge surface cooperate to prevent movement between the mouth of the latch housing and the striker bar in a direction substantially parallel to the first plane.

2. The latch assembly according to claim 1 wherein the latch includes a third wedge surface and the striker includes a fourth wedge surface.

3. The latch assembly according to claim 2 further including a second plane substantially perpendicular to the first plane, wherein the third wedge surface includes a region substantially parallel to the second plane.

4. The latch assembly according to claim 2 further including a second plane substantially perpendicular to the first plane, wherein the fourth wedge surface includes a region substantially parallel to the second plane.

5. The latch assembly as recited in claim 1 wherein the latch assembly is used in a vehicle.

6. The latch assembly according to claim 1 further including a second plane substantially perpendicular to the first plane, and wherein the first wedge surface is inclined relative to the second plane.

7. The latch assembly according to claim 1 further including a second plane substantially perpendicular to the first plane, and wherein the second wedge surface is inclined relative to the second plane.

8. The latch assembly according to claim 1 wherein at least one of the first wedge surface and the second wedge surface is a resilient surface.

9. The larch assembly according to claim 8 wherein the resilient surface is formed of a block of a resilient material.

* * * * *